US010357723B1

(12) United States Patent
Webster

(10) Patent No.: US 10,357,723 B1
(45) Date of Patent: Jul. 23, 2019

(54) AUTOMATIC INFLATABLE STRUCTURE DEFLATION SYSTEM

(71) Applicant: David Alan Webster, Londonderry, NH (US)

(72) Inventor: David Alan Webster, Londonderry, NH (US)

(73) Assignee: INNOVATIVE SAFETY SOLUTIONS INC., Stuart, FL (US)

( * ) Notice: Subject to any disclaimer, the term of this patent is extended or adjusted under 35 U.S.C. 154(b) by 18 days.

(21) Appl. No.: 15/933,369

(22) Filed: Mar. 22, 2018

(51) Int. Cl.
*A63G 31/12* (2006.01)
*A63H 3/06* (2006.01)

(52) U.S. Cl.
CPC ..... *A63G 31/12* (2013.01)

(58) Field of Classification Search
CPC .... A63G 31/00; A63G 31/12; A63B 2225/62; A63H 3/00; A63H 3/06
USPC ..... 472/134; 446/220–226; 52/2.17–2.25
See application file for complete search history.

(56) References Cited

U.S. PATENT DOCUMENTS 4,802,734 A * 2/1989 Walter ..... E04H 15/22 359/443
5,769,725 A 6/1998 Ogden et al.
6,565,405 B2 5/2003 Hsu et al.
6,668,475 B2 12/2003 Carolan
6,679,007 B1 1/2004 Minchew et al.
8,192,245 B2 * 6/2012 Deutsch ..... A47C 27/081 137/223
9,278,291 B2 3/2016 Scherba
2004/0050411 A1 3/2004 Lawrence
2007/0039247 A1 * 2/2007 Greenfeld ..... E04H 6/04 52/2.25
2008/0008544 A1 1/2008 VanElverginghe et al.
2015/0148141 A1 5/2015 Thompson et al.

FOREIGN PATENT DOCUMENTS

GB 1103997 5/1966

* cited by examiner

*Primary Examiner* — Kien T Nguyen
(74) *Attorney, Agent, or Firm* — Invention To Patent Services; Alex Hobson

(57) ABSTRACT

An automatic inflatable structure deflation system has a cover panel that is detachable attached over a deflation opening in the wall of the inflatable structure. The cover panel is pull away from the inflatable structure by a deflation line extending from the cover panel to a tie-down element in the event that the inflatable structure is displaced. The deflation opening is relatively large to enable quick deflation of the inflatable structure. A deflation opening may have a deflation opening area ratio, or area of the opening to the volume of air within the inflatable structure of 0.01 $cm^2/cc$ or more. A deflation opening may have a length of 25 cm or more. The cover panel is sealed to the inflatable structure by a seal feature such as a hook-and-loop fastener and/or a press-seal feature.

22 Claims, 6 Drawing Sheets

AUTOMATIC INFLATABLE STRUCTURE DEFLATION SYSTEM

BACKGROUND OF THE INVENTION

Field of the Invention

The invention relates to an automatic inflatable structure deflation system and method of deflating an inflatable structure using said system.

Background

Inflatable structures such as bounce houses or other occupant inflatable structures can have large surface area that catches the wind causing the inflatable structure to be displaced. An inflatable structure can become airborne and travel a considerable distance or to a dangerous height, and then drop abruptly. In some cases, an inflatable structure may be carried into the path of traffic onto power lines or into or in contact with other potential dangerous locations. High winds can cause tie-down lines to break or anchors to fail leaving the inflatable structures at the mercy of the wind.

SUMMARY OF THE INVENTION

The invention is directed to an automatic inflatable structure deflation system and method of deflating an inflatable structure using said system. An exemplary automatic inflatable structure deflation system comprises a cover panel that is sealed over a deflation opening and is tied to a tie-down element by a deflation line. When the inflatable structure is displaced, the deflation line pulls the cover panel from the inflatable structure to expose the deflation opening and to quickly deflate the inflatable structure. The deflation opening may be relatively large to enable quick deflation and prevent the inflatable structure from large displacements or from rising off of the ground to an unsafe height.

An exemplary automatic inflatable structure deflation system comprises a seal feature to seal the cover panel over the deflation opening and to the outside surface of the inflatable structure or to a seal panel attached to the outside surface of the inflatable structure. The seal feature may comprise a hook-and-loop fastener wherein one portion of the hook-and-loop fastener, the hook for example, is configured on the cover panel and the opposing portion of the hook-and-loop fastener, the loop, is configured on the outside of the inflatable structure, such as on the seal panel coupled to the inflatable structure and around the deflation opening. The seal feature may comprise a press-seal feature comprising a press-seal protrusion and a press-seal slot, wherein the press-seal protrusion is retained within the press seal slot to create a seal, like that of the zip-seals on many resealable plastic bags. A first portion of the press-seal feature is configured on the cover panel and the opposing portion of the press-seal feature is configured on the inflatable structure, such as on the seal panel. The press-seal feature may be in a continuous loop around the deflation opening and may have rounded corners to enable easy attachment of the press-seal protrusion into the press-seal slot. A seal may be substantially air-tight, wherein there is no more air lost through the seal than about 0.05 liter per minute per meter (lpm/m) of length of seal, no more than about 0.1 lpm/m, no more than about 0.5 lpm/m, no more than about 1 lpm/m and any range between and including the rates of air lost provided. A hook-and-loop seal feature may have higher air loss rates than a press-seal feature. The combination of the press-seal feature and hook-and-loop seal feature may provide low air loss rates and a secure fastening configuration. A hook-and-loop feature may be configured along the inside area, between the press-seal feature and the deflation opening and/or along an outside area, or outside of the press-seal feature. A hook-and-loop feature on the inside area may prevent force on the press-seal feature and prevent it from opening due to inflation pressure of the inflatable structure.

The deflation opening may be large to enable quick deflation of the inflatable structure and may be rectangular in shape, square in shape, circular in shape, oval in shape or irregularly shaped. The shape of the deflation opening may depend on the shape of the inflatable structure. A deflation opening may be configured on any of the sides of an inflatable structure, a top or a bottom of an inflatable structure. A deflation opening may have a largest dimension, such as length or diameter of about 25 cm or more, about 50 cm or more, about 100 cm or more, about 150 cm or more, about 200 cm or more any range between and including the deflation opening dimensions provided. The inflatable structure may comprise a deflation opening that has a deflation opening area ratio, or ratio of the surface area of the deflation opening to the volume of air within the inflatable structure, or $cm^2/cc$ that is large enough to enable quick deflation of the inflatable structure and may be about 0.01 $cm^2/cc$ or more, about 0.05 $cm^2/cc$ or more, about 0.05 $cm^2/cc$ or more, about 0.05 $cm^2/cc$ or more and any range between and including the deflation opening area ratios provided. The deflation opening area ratio may be calculated as a function of the entire volume of the inflatable structure or of a single bladder element of an inflatable structure, should the bladder elements be separated and filled separately.

An inflatable structure may be modified to include an automatic inflatable structure deflation system as descried herein. A kit may be provided having all the required components to convert an existing inflatable structure into an inflatable structure having an automatic inflatable structure deflation system. An exemplary automatic inflatable structure deflation system kit may comprise a cover panel having a seal feature on the inside surface and a deflation anchor attached thereto, a structure seal feature for attachment to the inflatable structure, a deflation line and a cutting template for marking the deflation opening on the inflatable structure. A user of the kit may place the cutting template on the inflatable structure and mark the deflation opening with a marker. A user may then cut the deflation opening through a wall of the inflatable structure. A user may then attach the structure seal feature around the deflation opening and to the outside surface of the inflatable structure, or wall of the inflatable structure. A user may then attach the cover panel to the structure seal and attach the deflation line to the deflation anchor and extend the line to a tie-down element, such as a stake in the ground. The inflatable structure is now equipped with an automatic inflatable structure deflation system. Note that the structure seal feature may be attached to a seal panel that is attached to the outside surface of the inflatable structure, such as with an adhesive.

An inflatable structure may have bladders comprising flexible fabrics, such as polymer coated woven fabric and may have one or more blowers that operate to keep the inflatable structure inflated. An inflatable structure may be an occupant inflatable structure having an interior configured for one or more occupants to enter. An inflatable structure may be an advertisement, such as a waving arm advertisement.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
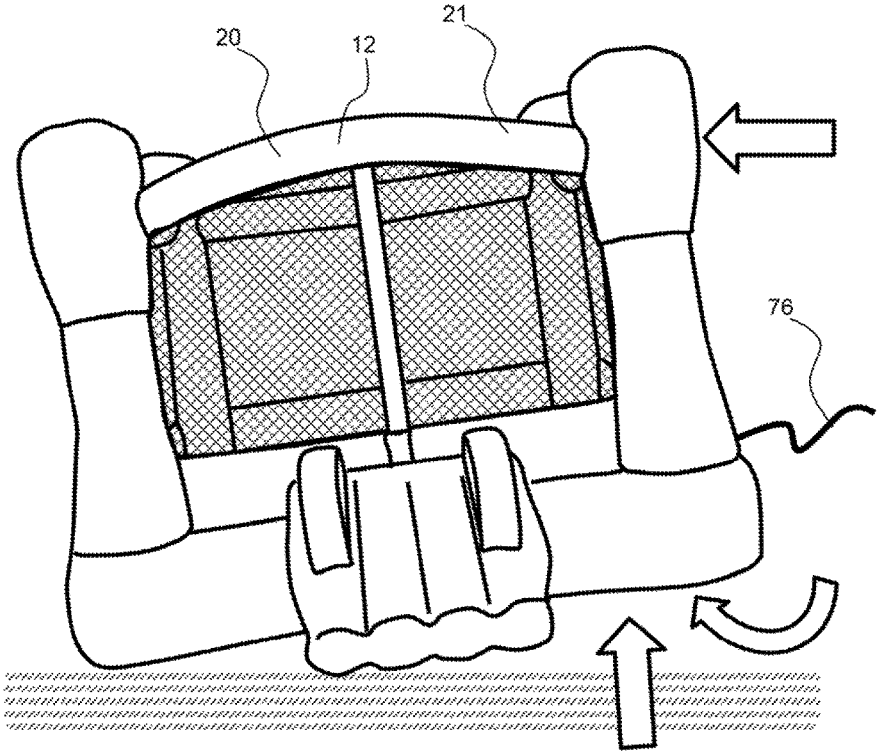
FIG. 1 shows a portable inflatable structure that is being lifted and displaced by wind.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Definitions

Inflatable structures, as used herein, refers to inflatable structures that are tied to the ground by a tie line and are configured to remain in contact with the ground. Some inflatable structures are configured for people to go inside, such as bounce houses and temporary structures and are referred to herein as occupant inflatable structures. An occupant inflatable structure has an interior large enough for one or more persons to enter and in some cases has a floor 29. These structures are particularly dangerous as displacement will also displace the people inside.

Length of the deflation opening, as used herein may be the largest straight-line dimension across a deflation opening and may be the diameter of a circular shaped deflation opening.

As shown in FIG. 1, a portable inflatable structure 20, a bounce house 21, or occupant inflatable structure 12, is being lifted and displaced by wind. Inadequately secured inflatable structures, such as the bound houses 21, can become airborne due to tie lines 76 breaking or tie anchors failing in high winds. People within the interior of the inflatable structure, such as on the floor 29 may be carried away with the bounce house and may fall out of the open top from a dangerous elevation or be dropped along with the bounce house. Inflatable structures such as bounce houses have been lifted by wind and carried by the wind a considerable distance or to a dangerous height and subsequently dropped. These events have resulted in injuries and in some cases death of the people inside.

Figure 2:
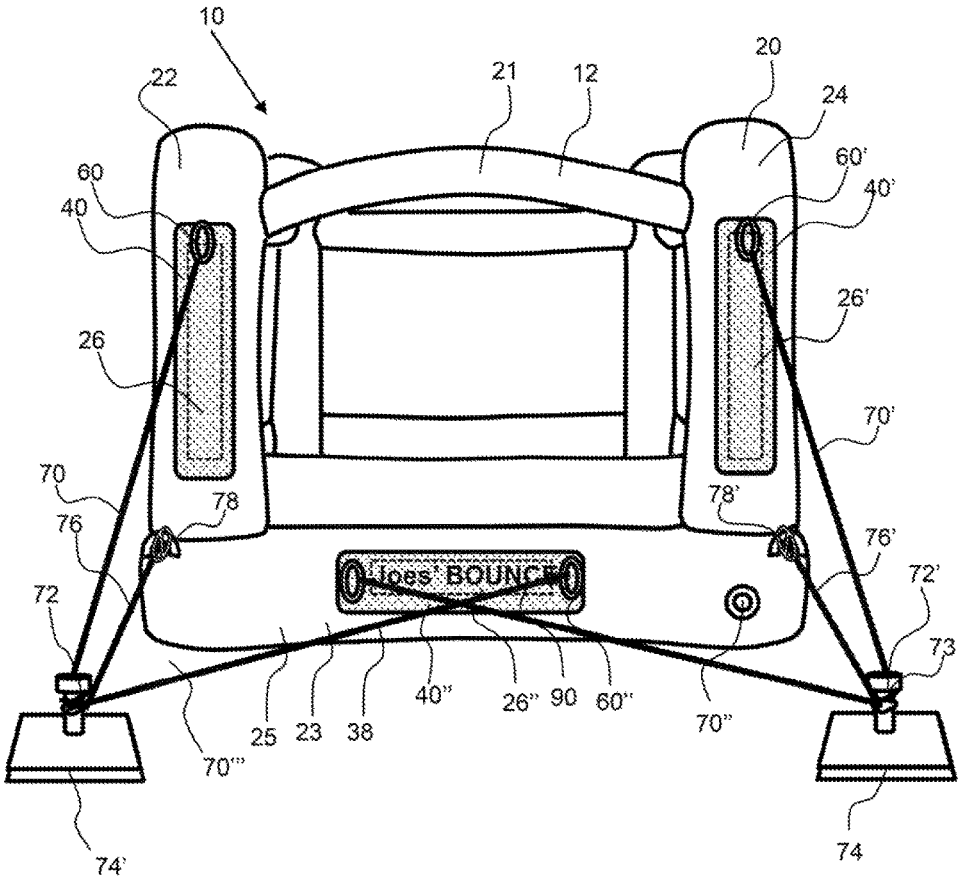
FIG. 2 shows a back view of an exemplary automatic inflatable structure deflation system that comprise a plurality of cover panels that are detachable from the inflatable structure to enable quick deflation.

As shown in FIG. 2, an exemplary automatic inflatable structure deflation system 10 comprises a plurality of cover panels 40-40" that are detachable attached to the back side of an inflatable structure 20 to enable quick deflation. The inflatable structure, a bounce house 21, has vertical portions 24, such as columns, and a base portion 25. The cover panels are coupled to the outside surface 23, or wall 38 of the inflatable structure and are configured to pull away from or detach from the inflatable structure in the event of high winds displacing the inflatable structure. Deflation anchors 60-60" are coupled to the cover panels 40-40" and a deflation lines 70-70'" extends from the deflation anchor to the tie down element 72, such as a tie-down post 73 or tie-down plate 74. Separate tie lines 76, 76' extend from the tie down element to tie anchors 78 on the inflatable structure. In the event that the tie lines break or the tie anchors fail, the inflatable structure may move and become airborne due to high winds. The cover panel extends over the deflation openings 26-26" in the inflatable structure and effectively seals the deflation openings to prevent air from escaping. If high winds displace the bounce house 21, one or more of the cover panels may be pulled away or detached from the inflatable structure to expose the deflation opening and deflate the bounce house quickly.

Figure 3:
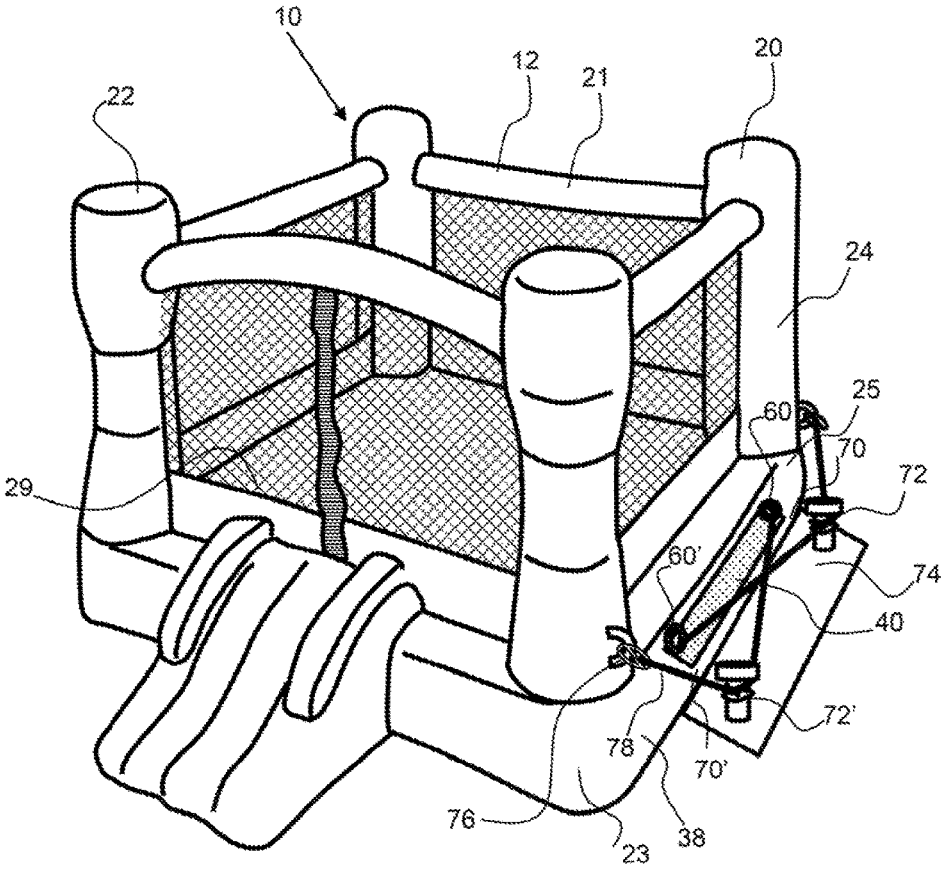
FIG. 3 shows a perspective view of an exemplary automatic inflatable structure deflation system that comprise a plurality of cover panels that are detachable from the inflatable structure to enable quick deflation.

As shown in FIG. 3, an exemplary automatic inflatable structure deflation system 10 comprises a cover panel 40 that is detachable from the side of an inflatable structure 20 to enable quick deflation. The inflatable structure, a bounce house 21, has vertical portions 24, such as columns, and a base portion 25. The cover panels are coupled to the outside surface 23 of the inflatable structure and are configured to pull away from or detach from the inflatable structure in the event of high winds displacing the inflatable structure. Deflation anchors 60-60' are coupled to the cover panel and deflation lines 70,70' extend from the deflation anchor to the tie down element 72, such as a tie-down post 73 or tie-down plate 74. The cover panel extends over the deflation opening 26 in the inflatable structure and effectively seals the deflation opening to prevent air from escaping. If high winds displace the bounce house 21, one or more of the cover panels may be pulled away or detached from the inflatable structure to expose the deflation opening and deflate the bounce house quickly. The cover panels may be configured on any portion of the inflatable structure, such as the sides, the back or front, and/or the top or bottom.

Figure 4:
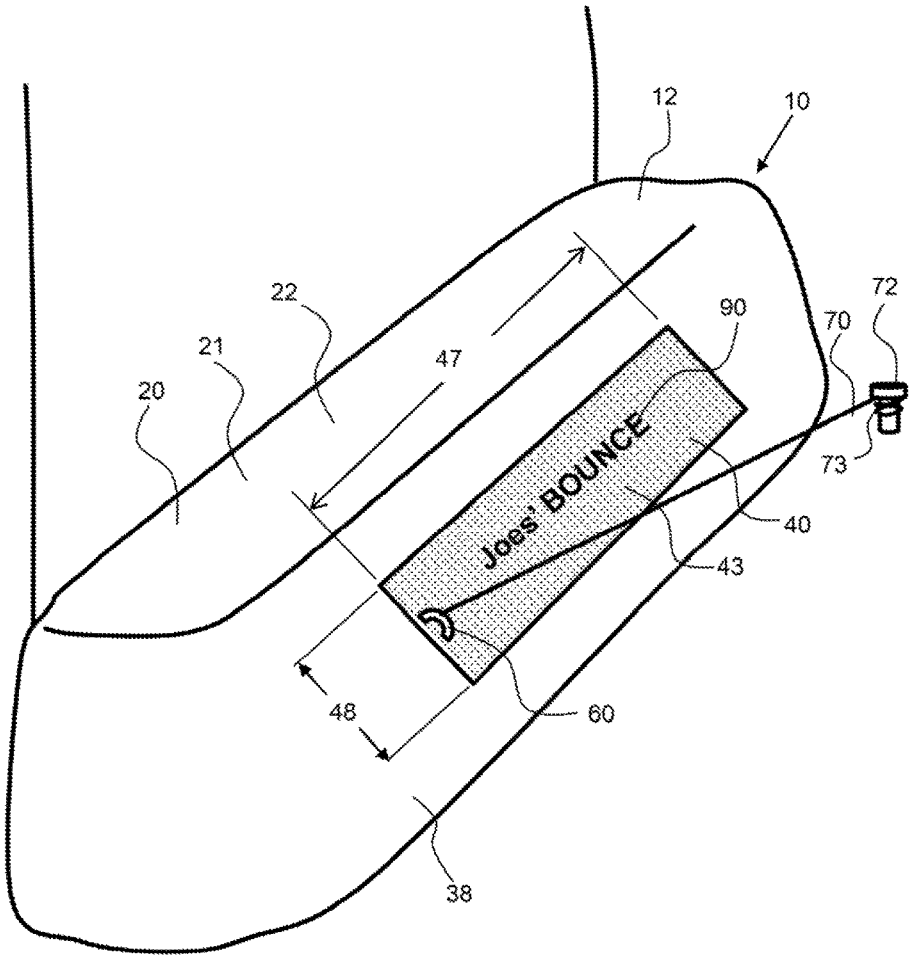
FIG. 4 shows a perspective view of an exemplary automatic inflatable structure deflation system with the cover panel secured over a quick deflation opening in the inflatable structure.
Figure 5:
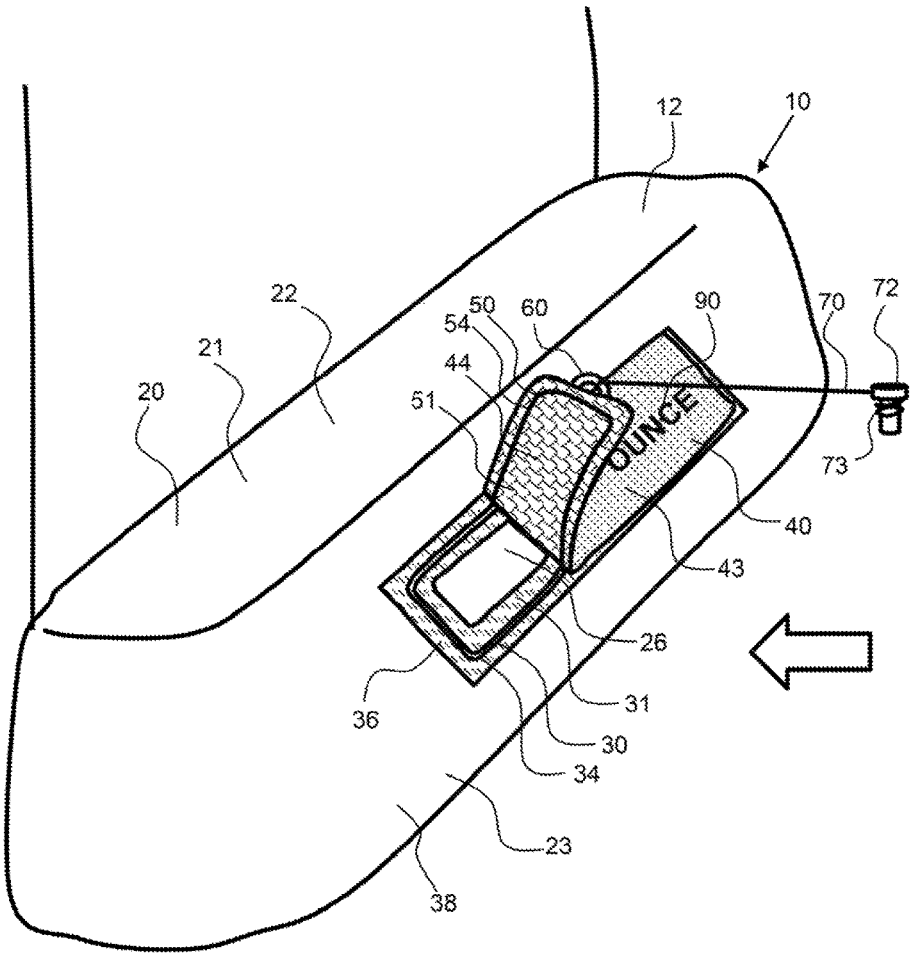
FIG. 5 shows a perspective view of an exemplary automatic inflatable structure deflation system with the cover panel being pulled away from the inflatable structure to expose the deflation opening in the inflatable structure.
Figure 6:
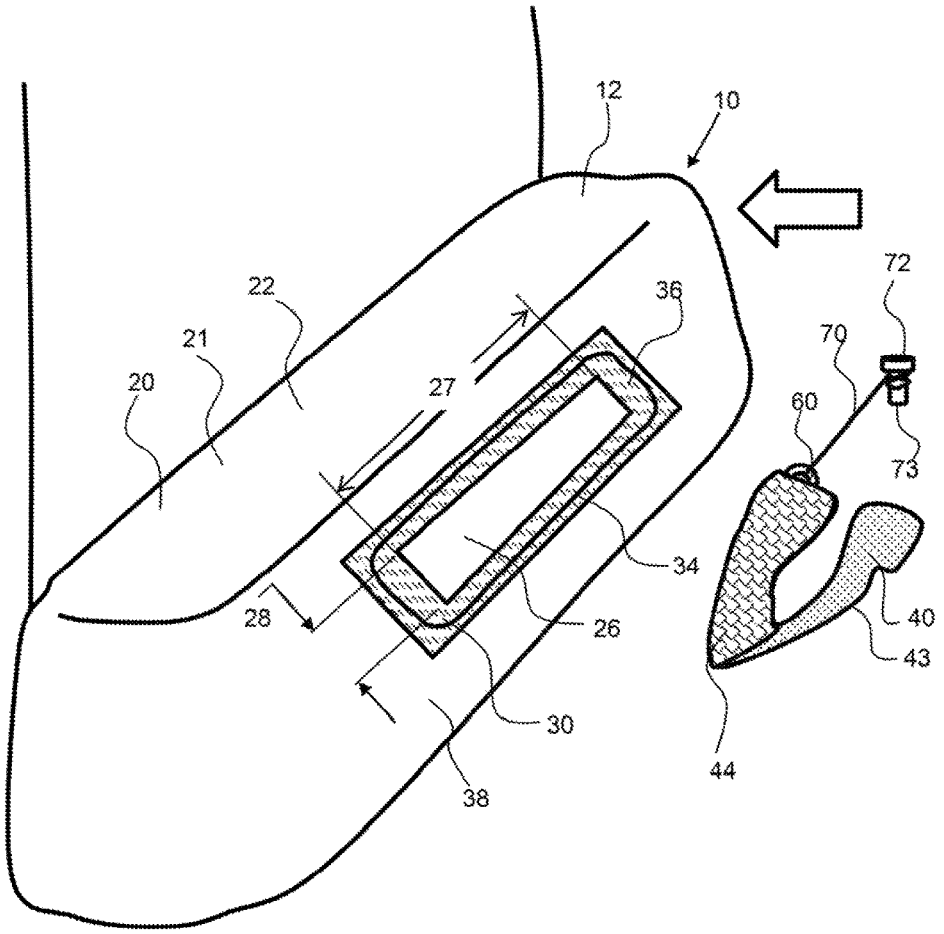
FIG. 6 shows a perspective view of an exemplary automatic inflatable structure deflation system with the cover panel removed from the inflatable structure to fully expose the deflation opening in the inflatable structure.

Referring now to FIGS. 4 to 6, an exemplary automatic inflatable structure deflation system 10 comprises a cover panel 40 that is detachable from the inflatable structure 20 to enable quick deflation. The cover panel 40 is detachably attached to the outside surface 23 of the inflatable structure and is configured to pull away from, or detach, from the inflatable structure in the event of high winds displacing the inflatable structure. A deflation anchor 60 is coupled to the cover panel and deflation line 70 extends from the deflation anchor to the tie down element 72, such as a tie-down post 73 or tie-down plate 74. As shown in FIG. 4, the cover panel extends completely over the deflation opening in the inflatable structure. The cover panel 40 has a length 47 and width 48 that are larger than the length and width, respectively, of the deflation opening.

As shown in FIG. 5, the inflatable structure 20 is being displaced as indicated by the bold arrow and the cover panel 40 is being pulled away from the outside surface 23 of the inflatable structure to expose the deflation opening 26. The inside surface of the cover panel 44 comprises a cover seal feature 50, such as a hook-and-loop fastener 51 and/or a press-seal component, such as a press-seal protrusion 54. The outside surface 23 of the inflatable structure 20 comprises a structure seal feature 30, such as the opposing portion of the hook-and-loop fastener 31 material from that on the cover panel, or the opposing portion of the press-seal feature, such as a press-seal slot 34. In is to be understood that the hook portion of the hook-and-loop fastener may be on either the cover panel or the outside surface of the inflatable structure and that the opposing portion, the loop, may be on the opposing surface to produce the seal. Likewise, the press-seal protrusion may be on the outside surface of the inflatable structure and the press-seal slot may be on the cover panel. The seal on the outside surface of the inflatable structure may be a seal panel 36 that is attached over an opening in the inflatable structure, such as with an adhesive, heat welding, stitching and any other suitable fastener. A seal panel is preferably attached to the outside surface of the inflatable structure with a fastener that produce an air tight seal. The outside surface 43 of the cover panel 40 may have a logo 90 printed thereon or may have a print or color to match that of the inflatable structure.

As shown in FIG. 6, the cover panel 40 has been completely detached from the inflatable structure 20 to expose the deflation opening 26. The deflation opening has a length and width that is effectively large to allow quick deflation of the inflatable structure should it be displaced by high winds. The seal panel 36 remains attached to the inflatable structure.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. An automatic inflatable structure deflation system comprising:

a) an inflatable structure comprising:
  i) an outside surface:
  ii) a deflation opening in the outside surface;
wherein the deflation opening has a length of at least 25 cm and a deflation opening area ratio that is 0.01 $cm^2/cc$ or more; and
  iii) a structure seal feature;
b) a cover panel configured over the deflation opening and comprising:
  i) a cover seal feature configured to couple with the structure seal feature to effectively prevent air from escaping through the opening in the inflatable structure;
  ii) a deflation anchor coupled to the cover panel;
c) a tie-down element;
d) a deflation line extending between and attached to the deflation anchor and to the tie-down element;
whereby displacement of the inflatable structure pulls the deflation line and the deflation anchor to detach the cover panel from the inflatable structure and expose the deflation opening and deflate the inflatable structure.

2. The automatic inflatable structure deflation system of claim 1, wherein the structure seal feature and the cover seal feature comprise a hook-and-loop fastener.

3. The automatic inflatable structure deflation system of claim 1, wherein the structure seal feature and the cover seal feature comprise a press-seal.

4. The automatic inflatable structure deflation system of claim 3, wherein the structure seal feature is a press-seal slot and the cover seal feature is a press-seal protrusion.

5. The automatic inflatable structure deflation system of claim 3, wherein the structure seal feature and the cover seal feature comprise a hook-and-loop fastener and a press-seal.

6. The automatic inflatable structure deflation system of claim 1, wherein the inflatable structure is a bounce house.

7. The automatic inflatable structure deflation system of claim 1, further comprising a seal panel that is attached to the outside surface of the inflatable structure and wherein the seal panel comprises the structure seal feature.

8. The automatic inflatable structure deflation system of claim 1, wherein the deflation opening is configured on a vertical portion of the inflatable structure.

9. The automatic inflatable structure deflation system of claim 1, wherein the deflation opening is configured on a base portion of the inflatable structure.

10. The automatic inflatable structure deflation system of claim 1, wherein the deflation opening has a length of at least 100 cm.

11. The automatic inflatable structure deflation system of claim 1, wherein the deflation opening has a deflation opening area ratio that is 0.1 $cm^2/cc$ or more.

12. A method of automatic deflating an inflatable structure comprising the steps of:

a) providing an automatic inflatable structure deflation system comprising:
  i) an inflatable structure comprising:
    an outside surface:

a deflation opening in the outside surface; and a structure seal feature;

wherein the deflation opening has a length of at least 25 cm and a deflation opening area ratio that is 0.01 $cm^2/cc$ or more;

ii) a cover panel configured over the deflation opening and comprising:

a cover seal feature configured to couple with the structure seal feature to effectively prevent air from escaping through the opening in the inflatable structure;

a deflation anchor coupled to the cover panel;

iii) a tie-down element;

iv) a deflation line;

b) attaching the deflation line to the deflation anchor and to the tie-down element;

wherein the deflation line extends between the deflation anchor and the tie-down element;

c) inflating the inflatable structure;

whereby displacement of the inflatable structure pulls the deflation line and the deflation anchor to detach the cover panel from the inflatable structure and expose the deflation opening and deflate the inflatable structure.

13. The method of automatic deflating an inflatable structure of claim 12, wherein the structure seal feature and the cover seal feature comprise a hook-and-loop fastener.

14. The method of automatic deflating an inflatable structure of claim 12, wherein the structure seal feature and the cover seal feature comprise a press-seal.

15. The method of automatic deflating an inflatable structure of claim 14, wherein the structure seal feature is a press-seal slot and the cover seal feature is a press-seal protrusion.

16. The method of automatic deflating an inflatable structure of claim 14, wherein the structure seal feature and the cover seal feature comprise a hook-and-loop fastener and a press-seal.

17. The method of automatic deflating an inflatable structure of claim 12, wherein the inflatable structure is a bounce house.

18. The method of automatic deflating an inflatable structure of claim 12, further comprising a seal panel that is attached to the outside surface of the inflatable structure and wherein the seal panel comprises the structure seal feature.

19. The method of automatic deflating an inflatable structure of claim 12, wherein the deflation opening is configured on a side of the inflatable structure.

20. The method of automatic deflating an inflatable structure of claim 12, wherein the deflation opening has a deflation opening area ratio that is 0.1 $cm^2/cc$ or more.

21. The method of automatic deflating an inflatable structure of claim 12, further comprising the steps of:

a) cutting said deflation opening in the inflatable structure;

b) attaching the structure seal feature around said deflation opening; and c) attaching the cover panel over the deflation opening; and d) coupling the cover seal feature configured to the structure seal feature to create a substantially air-tight seal;

wherein these steps are conducted before inflation of the inflatable structure.

22. The method of automatic deflating an inflatable structure of claim 21, wherein the structure seal in configured in a seal panel and wherein the method further comprises the step of attaching the seal panel to the outside surface of the inflatable structure.

* * * * *